United States Patent [19]

Willemsen et al.

[11] 4,428,160

[45] Jan. 31, 1984

[54] CENTERLESS VALVE GRINDING

[75] Inventors: Bernardus A. Willemsen, Sebright; Ray G. Parnham, Orillia, both of Canada

[73] Assignee: Ingenious Devices Limited, Orillia, Canada

[21] Appl. No.: 87,417

[22] Filed: Oct. 22, 1979

[51] Int. Cl.[3] ..... B24B 15/00

[52] U.S. Cl. ..... 51/129; 51/104; 51/105 VG; 51/132; 51/215 CP; 51/241 US; 51/166 FB; 82/1 A

[58] Field of Search ..... 82/1 A; 51/79, 103 R, 51/104, 105 VG, 129, 215 SF, 236, 237 R, 241 US, 289 R, 234, 215 CP, 166 FB, 165.78, 239, 131.1, 132; 125/13 SS

[56] References Cited

U.S. PATENT DOCUMENTS

| | | | |
|---|---|---|---|
| 1,202,400 | 10/1916 | McCullough | 51/129 |
| 1,422,749 | 7/1922 | Dameron | 51/215 CP |
| 1,452,508 | 4/1923 | Hervig | 51/105 VG |
| 1,533,133 | 4/1925 | Nickau | 51/105 VG |
| 1,590,190 | 6/1926 | Heim | 51/103 R |
| 2,221,918 | 11/1940 | Hall et al. | 51/105 VG |
| 2,389,787 | 11/1945 | Kuhns | 51/103 R |
| 2,544,318 | 3/1951 | Horberg | 51/289 R |
| 2,567,320 | 9/1951 | Christensen | 51/103 R |
| 2,927,404 | 3/1960 | Shoffner | 51/239 |
| 3,041,691 | 7/1962 | Vanier | 51/236 |
| 3,066,457 | 12/1962 | Moore | 51/237 R |
| 3,140,569 | 7/1964 | Murray | 51/236 |
| 3,857,204 | 12/1974 | Richard | 51/236 |

*Primary Examiner*—Harold D. Whitehead
*Assistant Examiner*—K. Bradford Adolphson
*Attorney, Agent, or Firm*—Sim & McBurney

[57] ABSTRACT

There is provided a valve grinding apparatus for centerless grinding of valves. Two base rollers with parallel axes are driven, and a control roller is centered above the base rollers. The control roller can be raised and lowered and the direction of its axis can be changed in order to cause the valve to be moved longitudinally in either direction. A support means is spaced from the base rollers and supports a different region of the valve stem.

7 Claims, 8 Drawing Figures

CENTERLESS VALVE GRINDING

This invention relates generally to valve grinding apparatus, and has to do specifically with a valve grinding apparatus utilizing the principle of centreless grinding.

BACKGROUND OF THIS INVENTION

While centreless grinding techniques have been used heretofore for the grinding of valves, for example of the kind used in the automobile industry, these prior uses have suffered from various drawbacks which it is an aspect of this invention to overcome.

Among the prior art considered in connection with this application are the following:

U.S. Pat. No. 1,533,133 Nickau, issued Apr. 14, 1925.

U.S. Pat. No. 1,452,508, Hervig, issued Apr. 24, 1923.

The drawbacks of the prior art relate to a lack of flexibility in the design, and to certain specific failings which will become clearer in the light of the following disclosure.

GENERAL DESCRIPTION OF THIS INVENTION

Accordingly, this invention provides a valve grinding apparatus, comprising

- a grinding wheel having an axis and means for driving the grinding wheel,
- two base rollers in side-by-side relation with parallel axes,
- drive means for positively driving the base rollers in the same direction so that the surface speeds of the base rollers are the same,
- a control roller centered above the base rollers, with the axis of the control roller in a plane parallel to the plane containing the axes of the base rollers,
- control means (a) for selectively raising and lowering the control roller with respect to the base rollers, and (b) for selectively varying the angle of the control roller axis in said parallel plane, such that the control roller can be angled to both sides of a central position in which the axis of the control roller is parallel with the axes of the base roller,
- support means spaced from the base rollers for supporting the region of a valve stem adjacent the valve to be ground, while a region of the valve stem more remote from the valve contacts the base rollers, the support means being generally between the grinding wheel and the base rollers, whereby the valve stem extends parallel to the base roller axes, said support means including means defining a V-shaped groove of which the flanks are stationary and have the same curvature as the respective base rollers, said support means further including a hold-down member supported above the apex of the groove for vertical movement, and means for urging the hold-down member downwardly against a valve stem supported in the groove,
- and stop means for establishing the maximum permitted valve stem movement in the direction from the support means toward the base rollers, said direction being the rearward direction.

GENERAL DESCRIPTION OF THE DRAWINGS

One embodiment of this invention is illustrated in the accompanying drawings, in which like numerals denote like parts throughout the several views, and in which.

Figure 1:
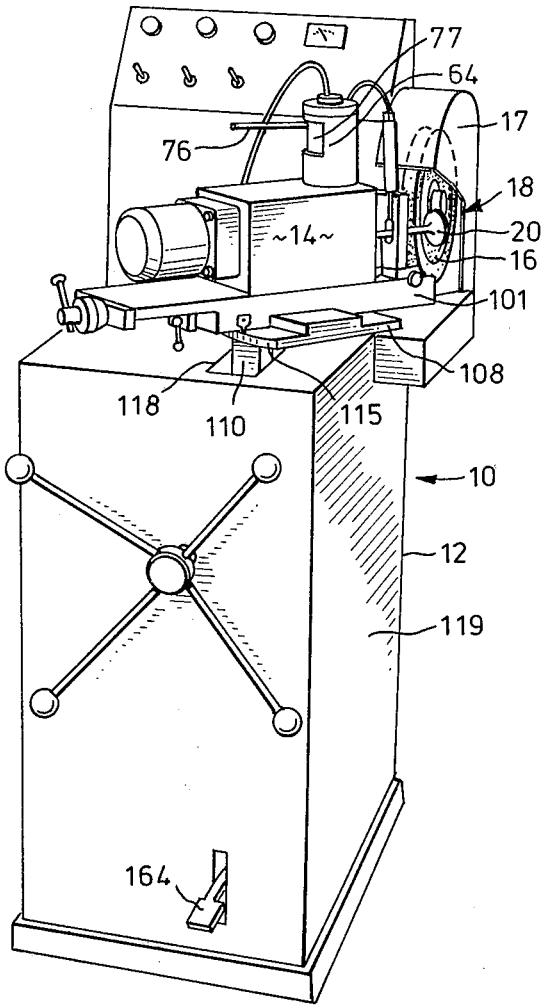
FIG. 1 is a perspective view of a complete apparatus for grinding valves.
Figure 3:
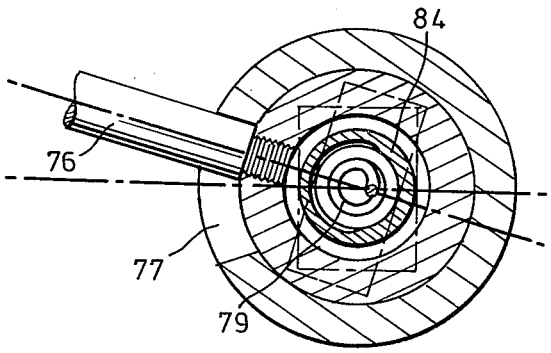
Figure 4:
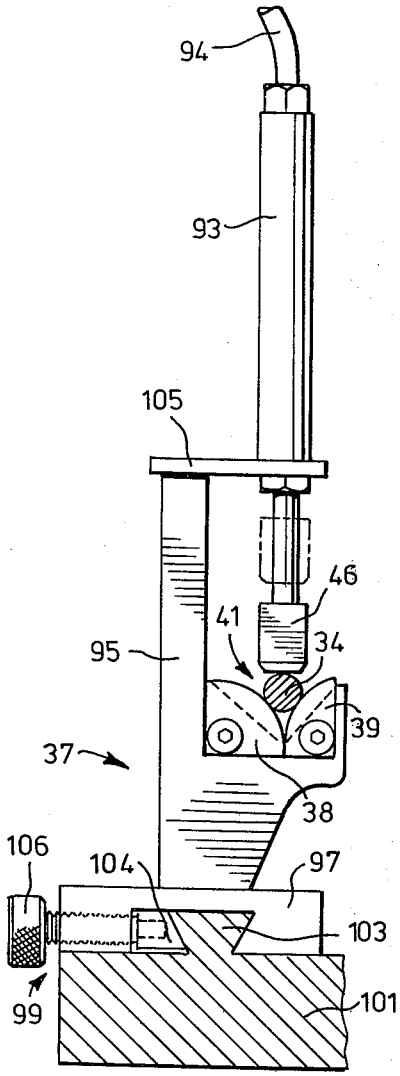
Figure 2:
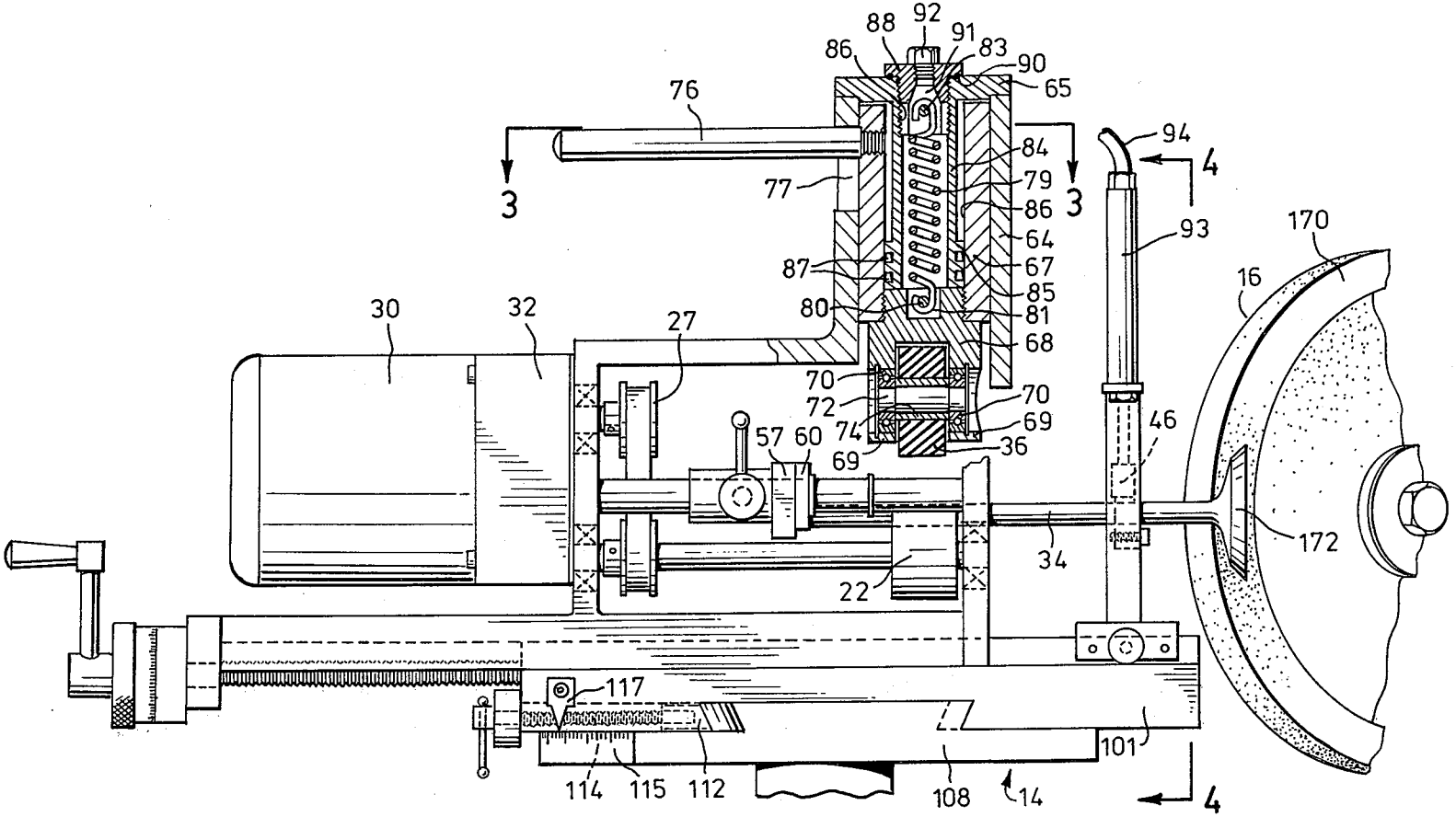
FIG. 2 is a longitudinal sectional view through a sub-frame which holds, controls and rotates the valve.
Figure 5:
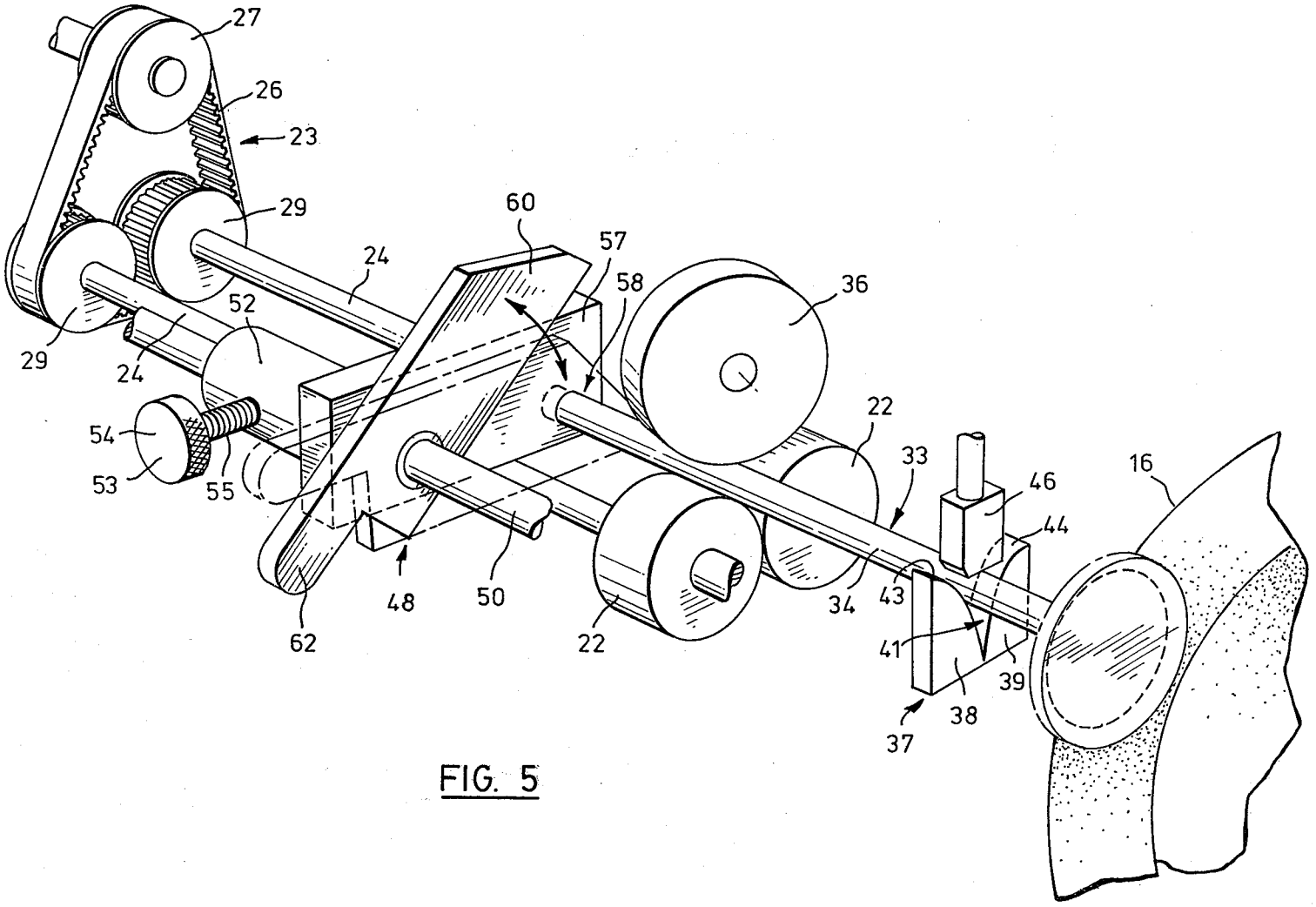
Figure 6:
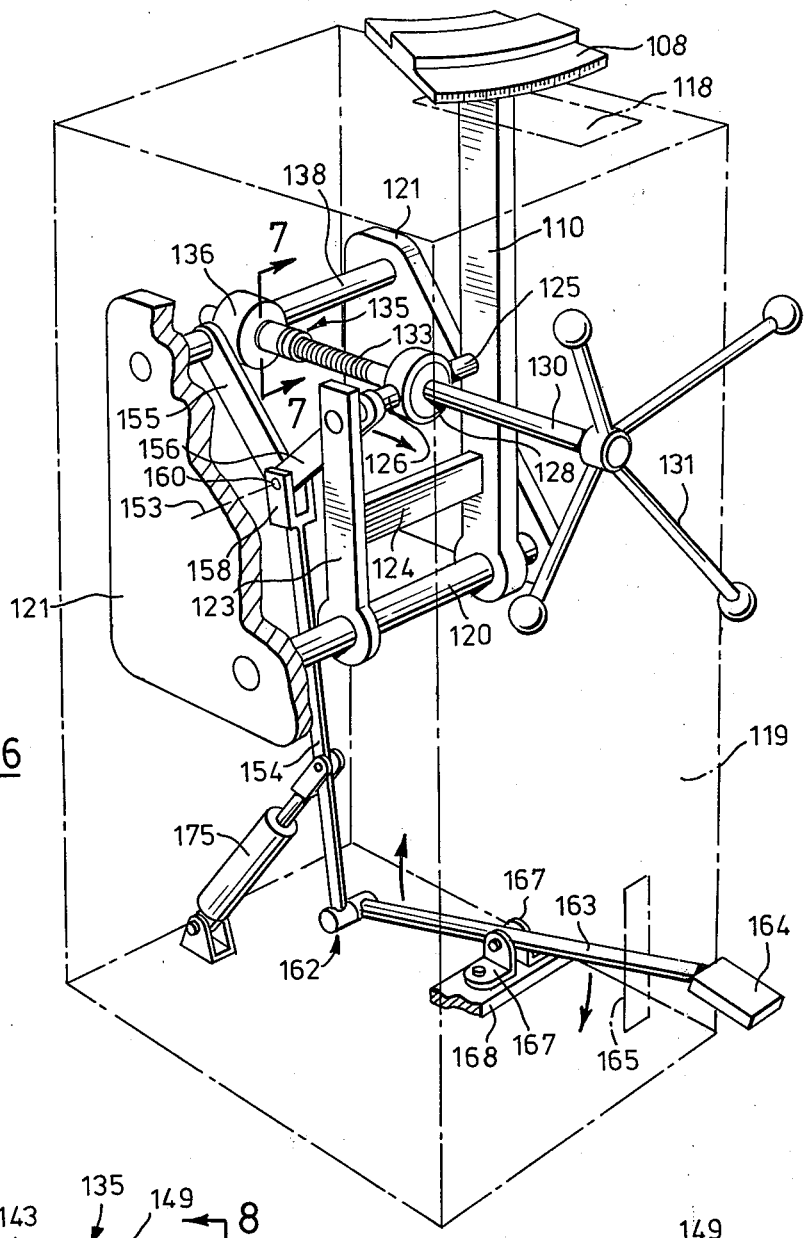
Figure 7:
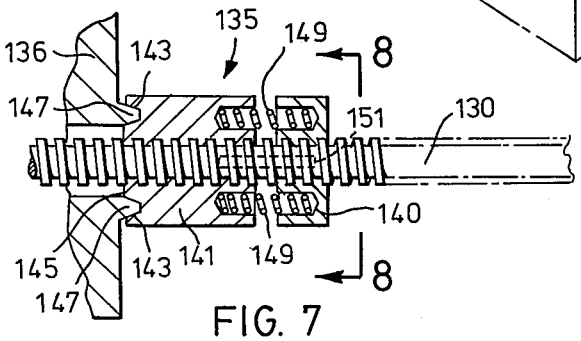

FIG. 3, on the same drawing sheet with FIG. 1, is a sectional view taken at the line 3—3 in FIG. 2;

FIG. 4, also on the same drawing sheet with FIG. 1, is a sectional view taken at the line 4—4 in FIG. 2;

FIG. 5 is a simplified schematic diagram illustrating the various rollers, the drive system and related components in the sub-frame shown in FIG. 2;

FIG. 6 is a partly broken away view of the base of the assembly of FIG. 1, showing the internal mechanism;

FIG. 7 is a sectional view taken at the line 7—7 of FIG. 6; and

Figure 8:
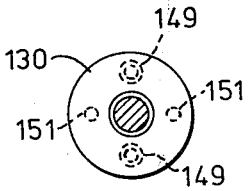

FIG. 8 is a sectional view taken at the line 8—8 in FIG. 7.

DETAILED DESCRIPTION OF THE DRAWINGS

Attention is first directed to FIG. 1, which shows a valve grinding apparatus generally at 10, which includes a main frame 12 and a sub-frame 14. A grinding wheel 16 of conventional nature is mounted with respect to the main frame 12, and can be rotated at high speed by an electric motor (not shown). As can be seen in FIG. 1, the grinding wheel 16 is covered by a housing 17 except for an access location 18, through which the head of a valve 20 can be ground.

The sub-frame will now be more particular described with reference to FIGS. 2, 3, 4 and 5.

The schematic FIG. 5 shows two base rollers 22 in side-by-side relation with their axes parallel, but spaced apart so that there is no frictional contact. Drive means shown generally at 23 is provided for positively driving the base rollers 22 in the same rotational direction, in such a way that their surface speeds are the same. In the embodiment illustrated in the drawings, the identity of surface speeds is attained by making the two base rollers 22 of the same diameter, mounting them on two parallel shafts 24, and rotating the two parallel shafts 24 at the same speed by means of a belt drive which includes a belt 26, a drive pinion 27, and two identical driven pinions 29, mounted on the shafts 24 respectively. The drive pinion 27 is rotated at a slow but constant speed by an electric motor 30 working through a speed reduction mechanism 32 of conventional nature.

It will be understood that the criterion of having the base rollers 22 rotate with the same surface speeds can be attained even if the base rollers are of different diameters, simply by adjusting the diameters of the driven pinions 29.

As can be seen in FIG. 5, a valve 33 can be arranged with its stem 34 resting in the "V" defined by the two base rollers 22, the valve stem being oriented parallel with the shafts 24.

To maintain the valve stem 34 in frictional contact with the surfaces of the base rollers 22, there is provided a freely turning control roller 36 which is centred above the base rollers 22, and which has its axis located in a plane parallel to the plane containing the axes of the base rollers. In the embodiment shown, the axes of the base rollers are identical with the axes of the shafts 24, and these axes are horizontal or substantially so, such that a plane passing through both axes would be horizontal. The freely turning control roller 36 has its axis also in a parallel plane, but in the condition shown in FIG. 5 the axis of the control roller 36 is not parallel with the axes of the base rollers 22. The control roller 36 is associated with mechanism, shortly to be described, which allows it to be raised and lowered with respect to the base rollers 22, and which allows it to swivel about a vertical line, thereby varying the angle of the control roller axis in its parallel plane, such that the control roller 36 can be angled to both sides of the central position, in which central position the control roller axis is parallel with the axes of the base rollers 22.

Located forwardly (rightwardly in FIG. 5) of the base rollers 22 is support means 37 for supporting one region of the valve stem 34 when another region thereof contacts the base rollers 22. The support means is such that, when it is so located, the valve stem 34 extends parallel to the base roller axes. More specifically, as seen in FIG. 5, the support means 37 includes two arcuate members 38 and 39 which together define a V-shaped groove 41 of which the flanks 43 and 44 have the same curvature as the respective base rollers 22. The support means 37 further includes a hold-down member 46 which is supported above the apex of the groove 41 for vertical movement. Means (shortly to be described) is provided for urging the hold-down member 46 downwardly against the valve stem 34 when the same is supported in the groove 41.

Stop means shown generally at 48 are provided for establishing the maximum permitted valve stem movement in the direction from the support means 37 toward the base rollers 22, this direction being referred to hereinafter as the rearward direction (leftward in FIG. 5).

The stop means 48 is seen in FIG. 5 to include a stationary shaft 50 fixed with respect to the sub-frame 14, a barrel 52 slidable on the stationary shaft 50, and a threaded locking member 53 constituting means adapted to lock the barrel 52 to the shaft 50 at any selected location. More specifically, the threaded lock member 53 has a knurled head 54 and a threaded shank 55, the latter being screwed into a suitably tapped bore extending through the wall of the barrel 52 at right angles to the axis thereof, such that the threaded shank 55 can be tightened against the shaft 50.

The barrel 52 supports two stop members: a permanent stop member 57 which is fixed to the barrel 52 and which has a region 58 adapted to be contacted by the valve stem 34 when the latter is supported on the base rollers 22 and moves rearwardly; and a temporary stop member 60 which is located forwardly of the permanent stop member 57, and which is pivoted with respect to the barrel 52. The temporary stop member 60 is selectively pivotable between an interposed position (shown in broken lines) in which it can be contacted by the valve stem 34, and a removed position (shown in solid lines in FIG. 5) in which the valve stem 34 can by-pass the temporary stop member 60 to contact the permanent stop member 57.

As seen in FIG. 5, the permanent stop member 57 is substantially rectangular in configuration, while the temporary stop member 60 is somewhat elongated, with a heavier portion extending in the direction of the contact location with the valve stem 34, and a lighter portion extending oppositely thereto. The lighter portion includes a depressible lever 62 which can be depressed manually in order to raise the operative contact portion of the temporary stop member 60 (that which would be contacted by the rearward end of the valve stem 34 if the temporary stop member 60 were located in the broken-line position shown in FIG. 5).

Referring now to FIGS. 1, 2 and 3, the control means for selectively raising and lowering the control roller 36 and for varying the angle of its axis, is seen to include a guide cylinder 64 to the top of which is bolted an end plate 65 (bolts not visible). As seen, the guide cylinder 64 is centred above the base rollers 22 and has its axis vertical, i.e. at right angles to the plane containing the axes of the base rollers 22, which in the embodiment illustrated is horizontal. A piston 67 is slidable in the guide cylinder 64, and the piston supports the control roller 36.

Looking at FIG. 2, the guide cylinder 64 is threadedly engaged with a lower end block 68, and the latter has two downwardly extending arms 69 in which are supported conventional ball bearings 70, the ball bearings supporting for rotation a shaft 72, which in turn supports the control roller 36 through a bushing 74. The piston 67 which supports the control roller 36 can reciprocate vertically within the guide cylinder 64, and can also rotate to a limited extent about its own axis within the guide cylinder 64.

Threadedly engaged in the wall of the piston 67, and extending perpendicularly to the axis of the same is a lever 76, which projects away from the piston through an opening 77 in the cylinder 64. The opening 77 has a greater circumferential extent than the diameter of the lever 76, and also extends vertically over a distance greater than the diameter of the lever 76. In actual fact, the opening 77 is approximately rectangular, or could be described more accurately as a rectangle laid upon the surface of the cylinder 64, and having rounded corners. Because the opening 77 has a greater width than the lever 76, limited rotational movement of the piston 67 about its own axis within the cylinder 64 is permitted. Because the opening 77 has a greater vertical extent than the diameter of the lever 76, vertical movement of the piston 67 within the cylinder 67 is possible.

Urging the piston 67 resiliently toward its uppermost position is a coil spring 79. The coil spring 79 is secured at its lower end to a shaft 80 located in a recess 81 in the lower end block 68. The upper end of the spring 79 is hooked around a shaft 83 which is secured with respect to the end plate 65. Integral with the end plate 65 is a coaxial, downwardly extending tubular portion 84, which has an upper part of smaller diameter than the inside diameter of the piston 67, and a lower part 85 which is received snugly but slidably within the inner bore 86 of the piston 67, with O ring-type sealing means 87 for effecting a seal.

The end plate 65 has a central tapped bore 86 therethrough, into which a plug 88 is threaded. A seal is effected between the plug 88 and the end plate 65 by means of an O-ring member 90. The plug 88 is centrally open at 91 and is tapped to receive a conventional connector 92 to which a pressurized air supply can be fed to the space within the tubular portion 84 (where the spring 79 is located). It will be appreciated that an increase in fluid pressure within the tubular portion 84 will eventually be able to overcome the urging of the spring 79, and will force the piston 67 to move downwardly, along with the lower end block 68 and the control roller 36.

The spring 79 is also able to exert a torque upon the pistons 67 with respect to the guide cylinder 64, by suitably angling the shafts 80 and 83. In practice, this torque tension is arranged in such a way that the piston 67 is turned as far as possible in the direction which will result in the control roller 36 causing the valve stem 34 to shift rearwardly toward the stop means 48. When the operator wishes to push the valve stem forwardly out of the sub-frame, or to cause it to "ride even" without being pushed either forwardly or rearwardly, he simply adjusts the position of the lever 76 to the corresponding location. To cause the valve stem to "ride even", the lever 76 would be placed in the middle location of the opening 77, so that the axis of the control roller 36 lies parallel with the axes of the base rollers 22. To push the valve stem 34 forwardly out of the gripping apparatus, the lever 76 is moved to the opposite side of the opening 77, so that the angulation of the control roller 36 is opposite to that which it normally assumes under the torque exerted by the spring 79.

Also shown in FIG. 2 is the means for raising and lowering the hold-down member 46 with respect to the groove 41. This means includes an air cylinder 93, and an air line 94, both of conventional construction.

Turning briefly to FIG. 4, the support means 37 is drawn to greater detail, and is seen to include a frame member 95, which supports the members 38 and 39 in such a way as to define the groove 41. The frame member 95 has a base 97 which has a conventional dovetail securement arrangement 99 so that it can be secured at various forward or rearward positions with respect to the base rollers 22. More specifically, the sub-frame includes a base member 101, having a dovetail ridge 103, and the base portion 97 of the frame member 95 defines a recess adapted to enclose the dovetail ridge 103. Part of the enclosure involves a wedge member 104 adapted to be urged rightwardly or leftwardly (in FIG. 4) by a threaded member 106. Further details of this construction are not necessary, since the construction is identical to that on present-day machine tools, such as lathes.

At the top of the frame member 95 is located a horizontal plate 105 to which is secured the lower end of the air cylinder 93.

Attention is now directed to FIGS. 1, 2, 6, 7 and 8, for a description of the way in which the sub-frame 14 is mounted to the main frame 12, and can be moved in various ways with respect thereto.

As can be seen in FIG. 1, the sub-frame 14 is mounted on an arcuate slideway 108, which is affixed atop a rocker link 110, which will be described more fully subsequently.

The base plate 101 of the sub-frame 14 is keyed in dovetail fashion to the arcuate slideway 108 in exactly the same manner as the keying shown at 99 in FIG. 4. More specifically, the arcuate slideway 108 defines an arcuate dovetail ridge which is received in a matching arcuate dovetail slot in the underside of the base plate 101, and a suitable wedge 12 controlled by a threaded member 114 is adapted to lock the base plate 101 in any desired location with respect to the arcuate slideway 108. A surface 115 of the arcuate slideway 108 is calibrated, and a pointer 117 serves to indicate particular points in the calibration, so that the operator can move the sub-frame 14 away from a given calibrated setting, and back again, with certainty that the precise same setting will be attained. As the sub-frame 14 is moved along the arcuate slideway 18 it rotates about a theoretical point close to the typical position of a valve head when the same is contained in and held by the sub-frame 14. By adjusting the sub-frame 14 with respect to the arcuate slideway 108, the precise grind angle on the sealing surface of the valve can be varied between 5° and 47°.

The rocker link 110 is adapted to rock longitudinally of a slot 118 cut in the top of a base housing 119, the slot 118 extending parallel to the plane of rotation of the grinding wheel 16. Thus, as the rocker link 110 moves toward and away from the grinding wheel 16, the entire sub-frame 14 is also carried toward and away from the grinding wheel 16. In the "away" position, a valve contained in the sub-frame 14 can be easily removed and replaced without dangerous contact with the grinding wheel 16.

When the operator is grinding a series of identical valves having identical lengths, it is of advantage timewise to be able to move the sub-frame 14 away from the grinding wheel 16 in order to exchange valves, and then return the sub-frame 14 to operative position with respect to the grinding wheel 16, in such a way that the sub-frame 14 always returns to precisely the same position. However, since valve lengths differ, it is also of advantage to be able to rapidly adjust the position of the sub-frame 14 with respect to the grinding wheel 16, when it has attained this "inner" position (i.e. when the rocker link 110 has moved inwardly as close as it can get to the grinding wheel 16). The mechanism which allows this combination of repeatability and adjustability will now be described with reference to FIGS. 6, 7 and 8.

As can be seen in FIG. 6, the rocker link 110 is secured at its lower end to a shaft 120 which is journalled for rotation in two opposed brace plates 121 secured to the inside of the base housing 119. Also secured to the shaft 120 is a link 123 spaced from the rocker link 110 and fixed with respect thereto through a cross piece 124 spaced above the shaft 120.

Above the cross piece 124, bridging shafts 125 and 126 support a bearing housing 128, containing a bearing which permits rotation but not longitudinal movement of a shaft 130 on the rightward end of which a handwheel 131 is affixed.

The bridging shafts 125 and 126 permit rotation of the bearing housing 128 about the common axes of the bridging shafts.

At its leftward end, the shaft 130 has external threads 133 engaging a composite stop 135 adapted to engage a trunion 136 supported on a rotatable shaft 138 journalled in the brace plates 121. The furthest leftward end of the shaft 130 passes through the trunion 136 by virtue of a central bore in the latter, which has an inner diameter larger than the outer diameter of the threads, so that no engagement between the shaft 130 and the trunion 136 takes place.

For a more detailed explanation of the working of the composite stop 135 and the trunion 136, attention is directed to FIG. 7.

In FIG. 7, it can be seen that the composite stop 135 consists of a forward member 140 and a rearward member 141, both of them cylindrical in outer configuration, and both of them in threaded engagement with the shaft 130. The rearward member 141 has two antipodal recesses 143 on its rearward face 145, and the trunion 136 has two matching forwardly directed protuberances 147 which are adapted to engage the recesses 143 when the shaft 130 is moved to the rear (leftwardly in FIG. 7), thereby establishing a furthest rearward position for the shaft 130, and a corresponding furthest rearward position for the rocker link 110 in the arcuate slideway 108.

When the shaft 130 is in its furthest rearward position, with the protuberances 147 engaged with the recesses 143, the said engagement prevents rotation of the composite stop 135, and rotation of the shaft 130 by means of the hand-wheel 131 will cause the shaft 130 to move forwardly or rearwardly with respect to the trunion 136, thus incrementally adjusting the position of the bearing housing 128, the rocker link 110, the arcuate slideway 108, and the sub-frame 14.

When the shaft 130 is moved forwardly (rightwardly in FIG. 7) away from the trunion 136, no restraint is exerted on the rearward member 141 against rotation, and any turning of the shaft 130 will tend to rotate the composite stop 135 along with it. To ensure that these two rotate together whenever the protuberances 147 are out of engagement with the recesses 143, the two members 141 and 140 of the composite stop 135 are spring-biased apart by virtue of two antipodal coil compression springs 149 located in suitable aligned bores in the members 140 and 141.

At locations spaced 90° from the springs 149 are guide pins 151 which lie in aligned bores of smaller diameter than the bores for the compression coil springs 149. Thus, the action of the coil springs 149 urges the respective members 140 and 141 away from each other, in order to "bind" the threaded engagement of each of the members with the threads of the shaft 130. This binding thus increases the frictional contact between the composite stop 135 and the shaft 130, whereby rotation of the latter will necessarily cause rotation of the former.

By virtue of the provisions just described, it will be understood that, whenever the rocker link 110 rocks forwardly (clockwise in the view of FIG. 6), due to forward movement of the bearing housing 128 and shaft 130, any accidental bumping against the hand-wheel and change in its rotational position will not change the longitudinal position of the composite stop 135 on the shaft 130, so that when the rocker link 110 is returned to its furthest inward position (furthest counter-clockwise in FIG. 6), the same innermost position will be established.

In order to cause the rocker link 110 and the arcuate slideway 108 to rock away from the grinding wheel 16 (clockwise in FIG. 6), there is provided a Y-linkage consisting of three links pivotally connected together at a central axis 153, the three links including a lower link 154, a rearward upper link 155, and a forward upper link 156. The lower link 154 has a fork 158 at the top, through which a shaft 160 passes. The inner ends of the upper links 155 and 156 are pivotally connected to the shaft 160.

The lower link 154 extends generally downwardly to a pivot arrangement 162, where it is connected to one end of a lever 163 having a foot pedal 164 at the other end. The lever 163 extends outwardly through a vertically elongated slot 165 in the base housing 119. The lever 163 is pivoted at an intermediate location by virtue of brackets 167 secured to a member 168 in turn secured to the bottom wall of the base housing 119.

It will thus be appreciated that downward pressure on the foot pedal 164 causes upward movement of the lower link 154, and upward pressure on the lower ends of the upper links 155 and 156.

As can be seen in FIG. 6, the rearward upper link 155 has its upper rearward end pivotally connected to the shaft 138, and since the latter is fixed with respect to brace plates 121, the upper pivoted end of the rearward upper link 155 cannot move.

The upper forward end of the other upper link 156 is pivoted to the bridging shaft 126, the latter of course being movable forwardly and rearwardly due to the fact that the links 110 and 121 are rotatable about their lower ends.

Hence, downward pressure on the foot pedal 164 causes the shaft 160 to be raised, which increases the angle defined between the upper links 155 and 156, and forces the upper forward end of the forward upper link 156 to move rightwardly, thus rotating the rocker link 110 in the clockwise direction as seen in FIG. 6, thus carrying the arcuate slideway 108 and the sub-frame 14 away from the grinding wheel 16.

It can now be seen that the apparatus herein described incorporates a high degree of flexibility and manoeuvrability by virtue of several of the provisions. Firstly, the control roller 36, unlike the control rollers in the prior art devices, can be selectively swivelled in a horizontal plane, to change the angle of its axis with respect to the base rollers 22, thereby adjusting the longitudinal forces applied to the valve stem 34, and reversing them where this is required. Secondly, in the prior art exemplified by Hervig U.S. Pat. No. 1,452,508, only the upper angulated roller is driven, providing only a single driving contact with the valve stem 34, which contact is a theoretical line. In the apparatus described herein, two of the three rollers are driven (the base rollers 22), and this increases the frictional grip against the valve stem 34. It is preferred that all rollers be made of a tough but somewhat resilient material, for example nylon, in order to attain an area of contact, rather than a mere theoretical line as would be the case with metallic rollers. Another advantage arising from the provision of resilient rather than metallic rollers is that it avoids the tendency of metal filings or chips to un-center the valve shaft by entering between the shaft and a non-resilient metallic roller. The resilient rollers simply yield to "absorb" the metal filing.

A further advantage relates to the support means 37 forwardly of the roller assembly, which support means simulates the surfaces of the base rollers 22, without requiring actual rollers to be provided. Naturally, freely running rollers could be positioned where the support means 37 is located, but the extra expense of providing shafts, etc. for such rollers is avoided by the construction provided herein. Additionally, by avoiding rolling supports, it is not possible for metal filings and chips to enter between the valve shaft and the supports. Any such filings etc. are simply "wiped off" at the contact between the shaft and the stationary support. Furthermore, it will be appreciated that, by making the flanks 43 and 44 of the members 38 and 39 of the support means 37 a match for the surfaces of the rollers 22, valve stems of different diameters may be ground, and their axes will still remain precisely parallel with the shafts 24 of the base rollers 22, although being raised or lowered to some extent with respect to the shafts 24.

Another advantage relates to allowing the stone 16 to grind the valve at its own speed dependent upon the pressure between the valve face and the stone, this pressure being established by the angulation of the control roller 36 and the air pressure controlling vertical pressure on the roller 36. In actual practice, the force urging the valve stem rearwardly is mainly controlled by adjusting the air pressure, since this can be set at a level corresponding to the size of the valve and the area of the face. The control roller 36 would usually be allowed to swing to the fully angulated position corresponding to rearward movement of the valve stem. In the case of the instant invention, the temporary stop 60 is first left in the operative position (broken lines in FIG. 5), as the valve 34 is inserted. The insertion takes place with the control roller 36 raised upwardly by the spring 79, due to the absence of air pressure being applied to the central cavity containing the spring 79. The control roller 36 is then lowered and the apparatus is switched on. As the base rollers 22 rotate, the valve stem 34 is gradually drawn rearwardly until its rearward end strikes the temporary stop 60. At this time, the arcuate slideway is in its furthest inward position, which is such as to cause the face of the valve to be adjacent to but not in contact with the outer side edge 170 of the grinding wheel 16. When the rearward end of the valve stem 34 has made contact with the temporary stop 60, the lever 62 is manually depressed, to remove the temporary stop 60 from contact with the valve stem 34. The continued rotation of the base members 22, combined with the angulation of the control roller 36 then attempts to carry the valve stem 34 further rearwardly toward contact with the permanent stop 57. However, before contact takes place, the face of the valve to be ground (shown at 172 in FIG. 2) will contact the grinding surface 170 of the grinding wheel 16, and grinding will commence. As material is removed from the face 172 of the valve, the entire valve is allowed gradually to move rearwardly, and eventually contact will take place with the permanent stop 57. When this has occurred, the face 172 will be evenly and completely ground.

In order to "polish" the face 172, the lever 76 can be moved to a middle position, so that the axis of control roller 36 is parallel with the axes of the base rollers 22, and this will allow the valve to simply "float" against the grinding wheel 16, which will have the effect of polishing the face 172. The latter procedure could be utilized before the valve stem had abutted against the permanent stop 57. Conversely, "polishing" will also take place after the valve stem has contacted the permanent stop 57, since no further rearward movement is then possible, and the valve face will simply "float" against the grinding wheel 16.

In order to change valves for the next grinding, the lever 76 is first moved to its further counterclockwise position as seen from above (to the side of the opening 77 opposite from the position shown in FIG. 3), and this will move the valve rightwardly or forwardly, which will have the effect of separating the face 172 of the valve from the grinding surface 170 of the grinding wheel 16. At this point, downward pressure with the foot on the foot pedal 164 will swing the entire sub-frame 14 outwardly away from the grinding wheel 16, thus allowing the operator to exchange valves. This is done by turning off the air pressure in the compartment containing the coil spring 79, and simultaneously releasing the air pressure in the air cylinder 93. This will allow the hold-down member 46 and the control roller 36 to move upwardly, allowing the operator simply to pick up the valve, remove it forwardly out of engagement, and then put the next valve into place.

Prior to putting the next valve into place, the operator will allow the temporary stop 60 to fall back down into its broken line position shown in FIG. 5, so that, initially, the new valve will not be drawn all the way back into grinding position with respect to the grinding wheel. When the next valve has been laid upon the base rollers 22, the operator activates the air pressure means to lower the control roller 36 and the hold-down means 46, whereby the valve is gripped. Rotation of the base rollers 22 then gradually carries the new valve rearwardly toward the temporary stop 60, which it eventually contacts. In this position (or prior to the contact between the valve stem 34 and the temporary stop 60) the operator allows the sub-frame to move inwardly toward the grinding wheel, by releasing pressure on the foot pedal 164. Once the sub-frame and the supported valve have reached the innermost position, the operator presses down on the lever 62 to remove the temporary stop 60 from interfering position, and the valve is gradually drawn rearwardly toward the fixed stop 57. As before, prior to contact with the fixed stop, grinding of the valve face commences.

In FIG. 6, a shock absorbing element 175 of conventional construction has been provided between the base housing 119 and an intermediate location of the lower link 154. This avoids "slamming" of the sub-frame 14 into its innermost and outermost positions.

We claim:

1. A valve grinding apparatus, comprising:

a grinding wheel having an axis and means for driving the grinding wheel, two base rollers in side-by-side relation with parallel axes, drive means for positively driving the base rollers in the same direction so that the surface speeds of the base rollers are the same, a control roller centered above the base rollers, with the axis of the control roller in a plane parallel to the plane containing the axes of the base rollers, control means (a) for selectively raising and lowering the control roller with respect to the base rollers, and (b) for selectively varying the angle of the control roller axis in said parallel plane, such that the control roller can be angled to both sides of a central position in which the axis of the control roller is parallel with the axes of the base roller, support means spaced from the base rollers for supporting the region of a valve stem adjacent the valve to be ground, while a region of the valve stem more remote from the valve contacts the base rollers, the support means being generally between the grinding wheel and the base rollers, whereby the valve stem extends parallel to the base roller axes, said support means including means defining a V-shaped groove of which the flanks are stationary and have the same curvature as the respective base rollers, said support means further including a hold-down member supported above the apex of the groove for vertical movement, and means for urging the hold-down member downwardly against a valve stem supported in the groove, and stop means for establishing the maximum permitted valve stem movement in the direction from the support means toward the base rollers, said direction being the rearward direction.

2. The apparatus claimed in claim 1, in which the base rollers have the same diameter and have surfaces capable of frictionally gripping a valve stem, and in which the base rollers rotate at the same speed, the plane containing the axes of the base rollers being substantially horizontal.

3. The apparatus claimed in claim 1 or claim 2, in which the control means comprises:

a guide cylinder located above the base rollers with the axis of the guide cylinder at right angles to the plane containing the axes of the base rollers, a piston slidable in the guide cylinder, the piston supporting the said control roller, a lever mounted to the piston and projecting away therefrom through an opening in the cylinder, said lever being the part of said control means which varies the angle of the control roller axis, resilient means constantly urging the piston away from the base rollers, and fluid pressure means selectively controllable to move the piston toward the base rollers against the urging of said resilient means.

4. The apparatus claimed in claim 1, in which the means for urging the hold-down member downwardly includes an air-operated cylinder.

5. The apparatus claimed in claim 1, in which said stop means includes a barrel slidable on a stationary shaft extending parallel to the axes of the base rollers, means on said barrel for locking the same to the shaft at a selected location, a permanent stop member fixed to the barrel and having a part which can be contacted by a valve stem when the latter is supported on said base rollers and moves rearwardly, and a temporary stop member forward of the permanent stop member and pivoted with respect to the barrel, the temporary stop member being selectively pivotable between an interposed position in which it can be contacted by a valve stem and a removed position in which a valve stem can by-pass the temporary stop member to contact the permanent stop member, the temporary stop member being biased toward the interposed position and being manually movable toward the removed position.

6. The apparatus claimed in claim 1, in which the base roller, the drive means, the control roller, the control means, the support means and the stop means are all mounted on a sub-frame movable with respect to a main frame, the grinding wheel and means for driving the grinding wheel being mounted to said main frame, said sub-frame being generally oriented such that the axes of said base rollers are angled with respect to the axis of the grinding wheel, the sub-frame being mounted directly to an arcuate slideway permitting limited rotational movement of the sub-frame with respect to the main frame in the horizontal plane about a theoretical point close to the typical position of a valve head, the slideway being mounted atop a rocker link pivoted at a location below the slideway for rocking movement such as to carry the slideway toward and away from the grinding wheel in a direction substantially perpendicular to the grinding wheel axis.

7. The apparatus claimed in claim 6, in which the rocker link has an innermost position in which a valve is held in a position to be ground, said innermost position being finely hand-adjustable, the rocker link being rockable outwardly in a given plane away from said innermost position by a Y-linkage having three links pivotally connected together at a central axis, the three links including a lower link extending generally downwardly, a first upper link extending obliquely inwardly and pivoted at the end thereof remote from the central axis to a further axis fixed with respect to the main frame, and a second upper link extending obliquely outwardly and pivoted at the end thereof remote from the central axis to a longitudinally fixed location on a horizontal rotatable shaft extending parallel to the plane of rocking movement of the rocker link and having an outer end and an inner end, said fixed location also being connected to said rocker link between the arcuate slideway and the pivot location of the rocker link, the rotatable shaft having a hand wheel on the outer end thereof and threaded engagement means on the inner end thereof, such that when the angle between the upper links is the smallest, thus causing the rocker link to move furthest inward, the threaded engagement means is engaged such that rotation of the hand wheel incrementally adjusts the innermost position of the rocker link; and means for selectively raising the lower link to disengage said threaded engagement means.

* * * * *